United States Patent [19]

Packschies et al.

[11] Patent Number: 4,462,228

[45] Date of Patent: Jul. 31, 1984

[54] APPARATUS FOR MERCERIZING TEXTILES AND FABRICS

[75] Inventors: Werner Packschies, Krefeld; Günther Miethe, Meerbusch, both of Fed. Rep. of Germany

[73] Assignee: Kleinewefers, Jaeggli AG, Rumikon/Elsau, Switzerland

[21] Appl. No.: 320,487

[22] Filed: Nov. 12, 1981

[30] Foreign Application Priority Data

Nov. 15, 1980 [DE] Fed. Rep. of Germany ..... 3043167

[51] Int. Cl.[3] ..... D06B 7/08

[52] U.S. Cl. ..... 68/22 R; 68/45; 68/62

[58] Field of Search ..... 68/44, 45, 62, 22 R, 68/158; 8/151

[56] References Cited

U.S. PATENT DOCUMENTS

| | | | |
|---|---|---|---|
| 3,270,532 | 9/1966 | Chaikin et al. | 68/45 |
| 3,802,838 | 4/1974 | De La Serviere | 68/44 X |
| 4,135,373 | 1/1979 | Conti | 68/22 R |
| 4,261,188 | 4/1981 | Mains | 68/62 |
| 4,324,116 | 4/1982 | Davis | 68/62 X |

FOREIGN PATENT DOCUMENTS

| | | | |
|---|---|---|---|
| 2738998 | 3/1979 | Fed. Rep. of Germany | 68/158 |

*Primary Examiner*—Philip R. Coe

*Attorney, Agent, or Firm*—Becker & Becker, Inc.

[57] ABSTRACT

An apparatus for mercerizing textiles and fabrics of cotton or cotton blends; the textile material, before and during impregnation with lye, is guided between a drum mantle and a synchronous liquid-permeable pressure band; removal of the lye is effected through the textile material while the latter is looped around the drum. The shrinkage of edges, especially of fabrics, is to be avoided both with certainty and also in a lasting manner. Also to be achieved is a complete impregnation of the textile material, as well as a removal and recovery of the strong lye without a dilution thereof by weak lye or water used for removal of lye. For this purpose, the apparatus of the present invention is characterized by a drum, around which is looped the textile material and the pressure band, and by a vat or immersion trough containing mercerizing lye into which the lower segment of the drum, with the textile material, dips or is immersed; above one or both upper profile quadrants of the drum is arranged a device for removing lye.

4 Claims, 2 Drawing Figures

APPARATUS FOR MERCERIZING TEXTILES AND FABRICS

Figure 1:
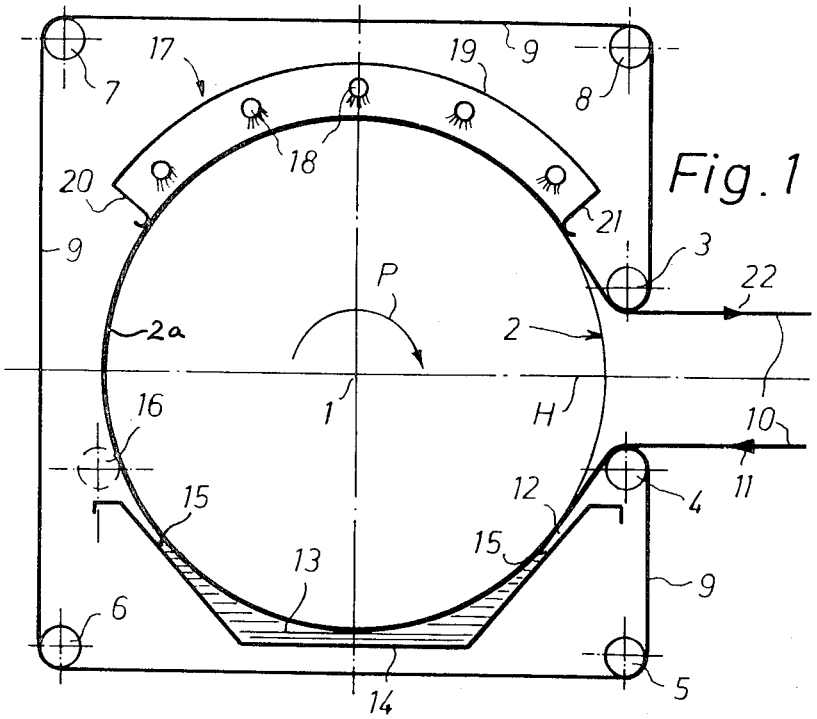

The present invention relates to an apparatus for mercerizing textiles and fabrics of cotton or cotton blends; the textile material, before and during impregnation with lye or caustic soda solution, is guided between a drum mantle and a synchronous liquid-permeable pressure band; removal of the lye is effected through the textile material, while the latter is looped around the drum.

German Pat. No. 118359 discloses a method of mercerizing fabric which, to prevent contraction of the edges of the fabric, is guided in a looped manner and under pressure along a path corresponding to the duration of the shrinkage effect of the lye on the fabric threads. German Pat. No. 119427, which includes an addition to German Pat. No. 118359, proposes that impregnation of the textile material occur during stretching thereof. For this purpose, a first embodiment provides a liquid-permeable drum mantle, the interior of which contains the mercerizing lye, which through radial openings of the tubular mantle can reach the textile material which is supported on the tubular mantle; the textile material slides along the wall of a trough-like countersupport. A second embodiment of the apparatus according to German Pat. No. 119427 discloses embodying the trough-like countersupport as a perforated upper wall of a lye trough or vat, whereby the lye is supposed to move upwardly, against the force of gravity, to the textile material located between the drum mantle and the curved upper wall which forms the countersupport.

German Pat. No. 27 22 125 discloses a method of mercerizing textiles or fabrics of cotton or of mixtures of cotton and synthetic fibers. According to this method, the textile material, after squeezing, is guided between two synchronized surfaces which press against each other. These surfaces preferably comprise a drum mantle and a pressure band. The advantage of this method compared with the method according to German Pat. Nos. 118359 and 119427 consists in that delicate textile material is carefully guided between a drum mantle and a synchronous pressure band, thus avoiding sliding effect on the textile material, which is especially disadvantageous when, because of different thicknesses of the textile material, or different types of textile material, the entire surface of the textile material is not supported by the trough-like countersupport. The irregular support of the textile material on the trough-like countersupport provides no assurance that shrinkage along the edges will be avoided. With this method disclosed in German Pat. No. 27 22 125, however, there exists the danger that already after leaving the lye container, shrinkage of the edges of the textile material strand occurs.

Finally, German Pat. No. 639367 discloses an apparatus for mercerizing fibers in loose condition with a perforated drum and a liquid-permeable pressure band; the textile material is supplied to the upper segment of the drum, where it is sprayed with mercerizing lye; the lower segment is sprayed with water or weak lye by radially and partially upwardly directed nozzles. The interior of the drum itself is provided with suctioning devices in order to suction the lye and the water through the textile material and the pressure band.

It is an object of the present invention, in contrast to the foregoing known apparatus, to avoid with certainty and in a lasting manner the shrinkage of the edges of the textile material during mercerization, especially of fabrics, yet with simple means to attain a complete and temporary impregnation of the textile material as well as a lasting removal and recovery of the strong lye without diluting the same by lye-removal water or weak lye.

Figure 2:
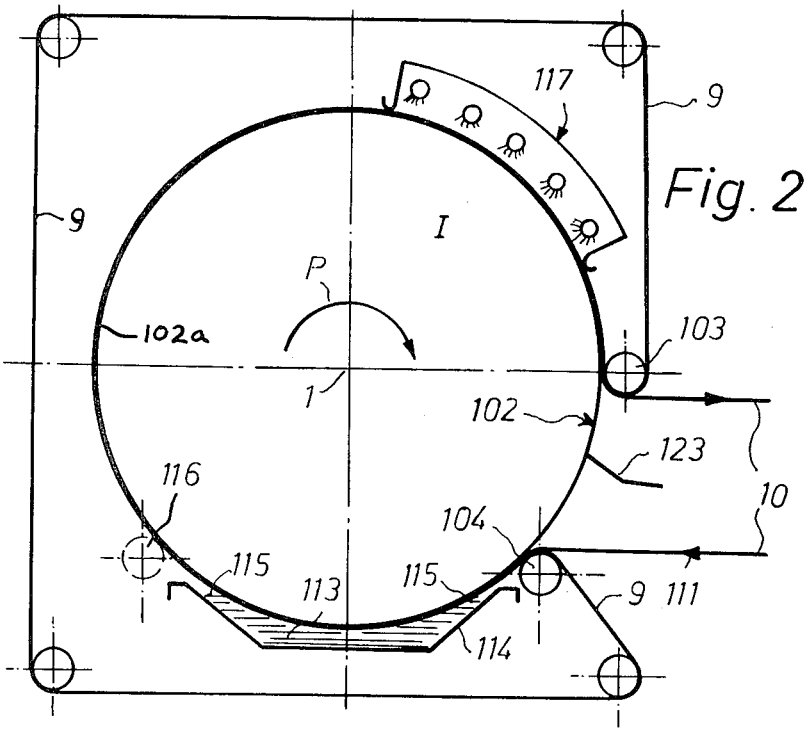

This object, and other objects and advantages of the present invention, will appear more clearly from the following specification in connection with the accompanying drawing, in which:

FIG. 1 illustrates one embodiment of the apparatus of the present invention; and FIG. 2 illustrates another embodiment of the apparatus of the present invention.

The apparatus of the present invention is characterized primarily by a drum, around which is looped the textile material and the pressure band, and by a vat or immersion trough containing mercerizing lye or caustic soda solution into which the lower segment of the drum, with the textile material, dips or is immersed; above one or both upper profile quadrants is arranged a device (e.g. nozzles) for removing lye.

According to further improvements and developments of the foregoing features, in the direction of movement of the drum, after the immersion trough, there may be arranged a squeeze roller which presses the liquid-permeable pressure band and the textile material against the drum mantle.

The apparatus may be provided with a shallow dip or immersion trough, and the nozzles for removing lye may be arranged above the first quadrant of the drum when the latter is rotated clockwise.

A wiper-like collecting- and wiping-plate may be provided for the lye-removal liquid accumulated during the removal of lye.

The advantage of the present invention is that a simple closed drum mantle can be utilized, and by pressing the textile material against the drum mantle, already before, and at the latest at the beginning, of the immersion into the mercerizing lye there is assured that already with the first contact of the textile material with the lye, a strong engagement of the textile material against the drum mantle is provided, which preferably can be provided with a surface which precludes shrinkage. In order, however, to preclude shrinkage of the textile material during withdrawal thereof from the drum mantle, the removal of lye is effected while the textile material is still looped around the drum mantle; lye removal is effected through the textile material, while the latter is pressed against the drum mantle, in such a way that the removal of lye from the textile material still occurs in the full-width position of the textile material between the drum mantle and the pressure band. When the textile material leaves the drum mantle, it is free of lye and there no longer exists any danger of shrinkage of the edges. Even more important is that as a result of the immersion of the textile material in the lye for a short distance, an intensive wetting of the textile material occurs, and adjoining the wetting stretch in the lye there is a stretch where the lye acts on the textile material. Along this stretch the excess lye returns undiluted from the textile material and the pressure band to the lye container, while the lye-removing water or the weak lye in the upper drum segment is taken along by the textile material and the pressure band and is collected separately from the mercerizing lye.

Referring now to the drawing in detail, the apparatus of FIG. 1 includes a drum 2 having a drum mantle 2*a* and rotatable about an axis 1 in the direction of the arrow P; guide or direction-reversing rollers 3,4 are associated with the drum mantle 2*a* on one side thereof in the vicinity of the horizontal line H. The drum 2 is further surrounded by guide rollers 5,6,7,8, with a pressure band or belt 9 being looped around these rollers, and also around the rollers 3,4 and the drum mantle 2*a*. This pressure band 9 is a liquid-permeable belt which is provided with small holes, or is woven of metallic or other suitable threads or filaments.

The web or strand of textile material 10 is pressed against the drum mantle 2*a* by the pressure band 9. The textile material strand 10 enters the apparatus in the direction of the arrow 11, partially loops around the roller 4, and, above the lye or caustic soda level 15, is pressed against the drum mantle 2*a* in the area between this roller 4 and the entry or inlet region 12 of a trough or vat 14 which is filled with mercerizing lye or caustic soda solution 13. The surface of the drum mantle 2*a* can suitably be made in such a manner as to prevent shrinkage of the textile material. The pressure band 9, along with the textile material 10, which rests on the drum mantle 2*a* and is synchronous with the band 9, pass through the lye solution 13, with the lye, which passes through the pressure band 9, impregnating the entire surface of the textile material 10. A squeeze roller 16 can be provided after the trough or vat 14 as seen in the direction of rotation of the drum 2.

In the respectively upper region of the drum mantle 2*a*, and in a mirror-inverted or nearly mirror-inverted relationship to the horizontal line H, there is provided the lye-removing device 17, which includes sprayers 18 for a lye-removal medium, for instance water or weak lye. These sprayers 18 are directed against the pressure band 9 and against the strand of textile material. The sprayers 18 can be covered by a hood 19, the lower ends of the front wall 20 and rear wall 21 of which sealingly engage the pressure band 9. Also in the region of the lye-removing device 17, the textile material web or strand 10 engages the drum mantle 2*a* by means of the pressure band 9 in such a manner that also during the removal of the lye no shrinkage of the edges of the textile material strand can occur, so that the textile material leaves the apparatus in the direction of the arrow 22 without any danger of further shrinkage.

A liquid-permeable pressure band 9 is also utilized with the embodiment of FIG. 2. The textile material 10, in the direction of the arrow 111, reaches one of the guide rollers 104. Again, between a trough or vat 114 containing mercerizing lye or caustic soda solution 113, and this guide roller, the textile material is pressed by the pressure band 9 against the drum mantle 102*a*. The textile material 10 thus comes into fixed engagement against the mantle 102*a* before the pressure band 9 and the textile strand 10 reach the lye level 115 in the trough or vat 114. A squeeze roller 116 can again be arranged after the shallow construction of the trough or vat 114.

With the embodiment according to FIG. 2, the looping angle around the drum 102, which rotates about the axis 1 in the direction of the arrow P, is greater than 180°, and extends to the lye-removing device 117, which is located in the first quadrant I of the drum mantle, is provided with lye-removing sprayers 18, and has the same or a similar structure to the lye-removing device 17 of FIG. 1. Upon leaving the apparatus, the pressure band and the textile material strand are looped around the roller 103. A collecting- and wiping-plate 123 for the lye-removing liquid can be provided between the roller 103 and the roller 104.

In the trough or vat 14 and 114, a complete saturation or saturation of the textile material with mercerizing lye or caustic soda solution occurs. On that portion laterally above the trough or vat 14 or 114, the textile material passes through a section where the lye acts on the textile material. Along this section, excess mercerizing lye returns undiluted to the trough or vat 14 or 114. The water or weak lye introduced to the upper drum segment is taken along by the textile material or the pressure band 9 in the direction of rotation of the drum 2, 102 and can accordingly be recovered separately from the mercerizing lye in the trough or vat 14 or 114. For this purpose, the embodiment of FIG. 2 is especially advantageous.

The present invention is, of course, in no way restricted to the specific disclosure of the specification and drawing, but also encompasses any modifications within the scope of the appended claims.

What we claim is:

1. A single apparatus for mercerizing and caustic-soda-lye removal from fabrics of cotton or cotton blends with two different liquid media, said apparatus in combination comprising:

a single drum having a closed-surface mantle as well as having a lower portion and upper profile quadrants, textile material being movable about and looped around said drum;

a liquid-permeable pressure band looped around said drum, said pressure band moving synchronously with said textile material and pressing the latter against said drum mantle;

an immersion trough containing as one of said two liquid media mercerizing lye for impregnating said textile material and connected with a supply for mercerizing lye, with at least a part of only the lower portion of said drum, with said textile material looped therearound, being immersed in said trough, said textile material being guided between said drum mantle and said pressure band before and after, as well as during, said impregnation; and a device arranged above at least one of the upper profile quadrants of said drum for removing lye from said textile material absorbed in said trough with the other of said two liquid media, removal of lye being effected through said textile material while the latter and the pressure band are still looped around said single drum and while maintenance of width of said textile material occurs therewith to assure against shrinkage of the textile material.

2. An apparatus in combination according to claim 1, which includes a squeeze roller which, when viewed in the direction of rotation of said drum, is arranged after said immersion trough, said squeeze roller pressing said pressure band and said textile material against said drum mantle.

3. An apparatus in combination according to claim 2, in which said drum rotates in a clockwise direction, said immersion trough is a shallow trough, and said lye-removing device includes sprayers arranged above the first quadrant of said drum, said sprayers dispensing lye-removal liquid on said pressure band.

4. An apparatus in combination according to claim 3, which includes a wiper-like collecting and wiping plate for collecting lye-removal liquid accumulated during said removal of lye from said textile material.

* * * * *